US006695677B1

(12) United States Patent
Lin

(10) Patent No.: US 6,695,677 B1
(45) Date of Patent: Feb. 24, 2004

(54) BRA STRUCTURE

(75) Inventor: Guey-Ren Lin, Taipei (TW)

(73) Assignee: Worldwide Golden Enterprise Co., Ltd., Taipei (TW)

( * ) Notice: Subject to any disclaimer, the term of this patent is extended or adjusted under 35 U.S.C. 154(b) by 0 days.

(21) Appl. No.: 10/230,675

(22) Filed: Aug. 29, 2002

(51) Int. Cl.[7] ..... A41C 3/00
(52) U.S. Cl. ..... 450/41; 450/57
(58) Field of Search ..... 450/39–41, 46, 450/47, 51–53, 55, 57, 92, 93; 2/267, 255, 256, 258, 259, 260, 260.1, 261, 264

(56) References Cited

U.S. PATENT DOCUMENTS 5,967,877 A * 10/1999 Howard ..... 450/57
6,435,939 B1 * 8/2002 Lin ..... 450/41
6,447,365 B1 * 9/2002 Powell et al. ..... 450/41

* cited by examiner

*Primary Examiner*—Gloria M. Hale
(74) *Attorney, Agent, or Firm*—Pro-Techtor International Services

(57) ABSTRACT

A bra structure with an arcuate steel wire placed inside a groove channel at a bottom rim of a breast cup of the bra. The top and bottom portions of the steel wire are affixed by a foam which is adhered by a patch fabric. When the bra is assembled with a die casting machine to mold twice at a high temperature, the steel wire is completely fixed inside the groove channel of the breast cup. This not only saves manufacturing labor time, but also allows the steel wire to entirely and closely affix to the breast cup to more completely support the breast shape.

1 Claim, 7 Drawing Sheets

BRA STRUCTURE

BACKGROUND OF THE INVENTION

1) Field of the Invention

The present invention relates to a bra structure, and more particularly to a bra with a steel wire being fixed onto a groove channel of a breast cup when a die casting machine molds the breast cup at a high temperature twice; the outer rim of the breast cup requires no additional seaming of a bent tube for inserting the steel wire so as to not only save the labor time and cost for manufacturing, but also improve the appearance of the entire bra.

2) Description of the Prior Art

Accordingly, a traditional bra, as indicated in FIG. 7, has a ring-shaped bent tube (20) seamed respectively on lower cup rims (101) of two breast cups (10); the bent tube (20) has a steel wire (30) inserted therein; a tube opening (201) of the bent tube (20) is seamed to make the steel wire (30) support on the lower rim of the breast cup (10) thereby eliminating the breast shape of the bra to deform due to insufficient firmness.

However, the abovementioned conventional bra has the following drawbacks:

1. It is necessary to seam the bent tube (20) onto the lower cup rim (101) of the breast cup (10) for inserting the steel wire (30); therefore, it takes extra seaming labor and time for mass producing the bra thereby increasing the manufacturing cost.
2. For facilitating the seaming of the tube opening (201) of the bent tube (20), the steel wire (30) inserted inside the bent tube (20) does not fill in the entire bent tube (20) completely. Therefore, the tube opening (201) areas at two ends of the bent tubes (20) have no supporting function and that causes the support of the breast shape of the bra become incomplete.
3. The bent tube (20) seamed on the lower cup rim (101) of the breast cup (10) destroys the entire external view and aesthetic of the bra.

SUMMARY OF THE INVENTION

Therefore, the primary objective of the present invention is to position two steel wires inside two breast cups of a bra into two groove channels at lower rims of the breast cups through using a die casting machine to mold at a high temperature twice without seaming and inserting for fixing so as to save the labor time and cost for manufacture and to enable the steel wires affixed closely to the breast cups to support the breast shape of the bra more completely.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
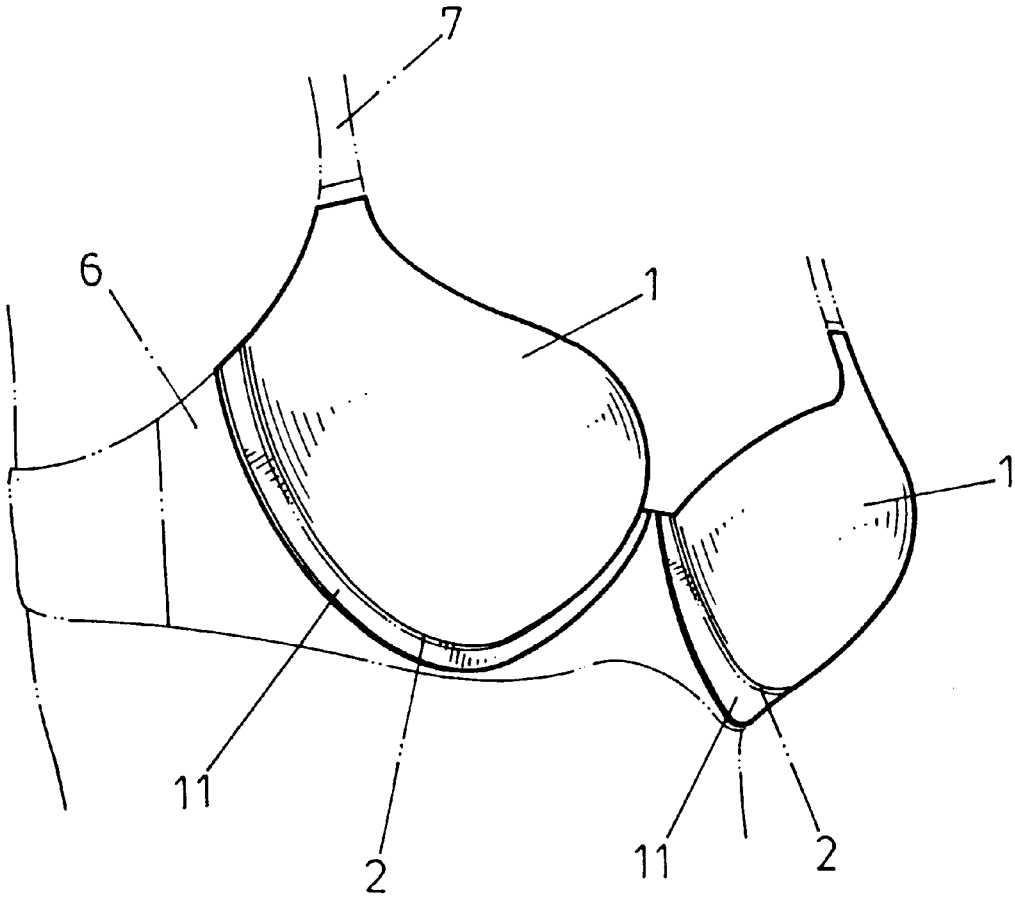
FIG. 1 is a drawing of an external view of the present invention.
Figure 2:
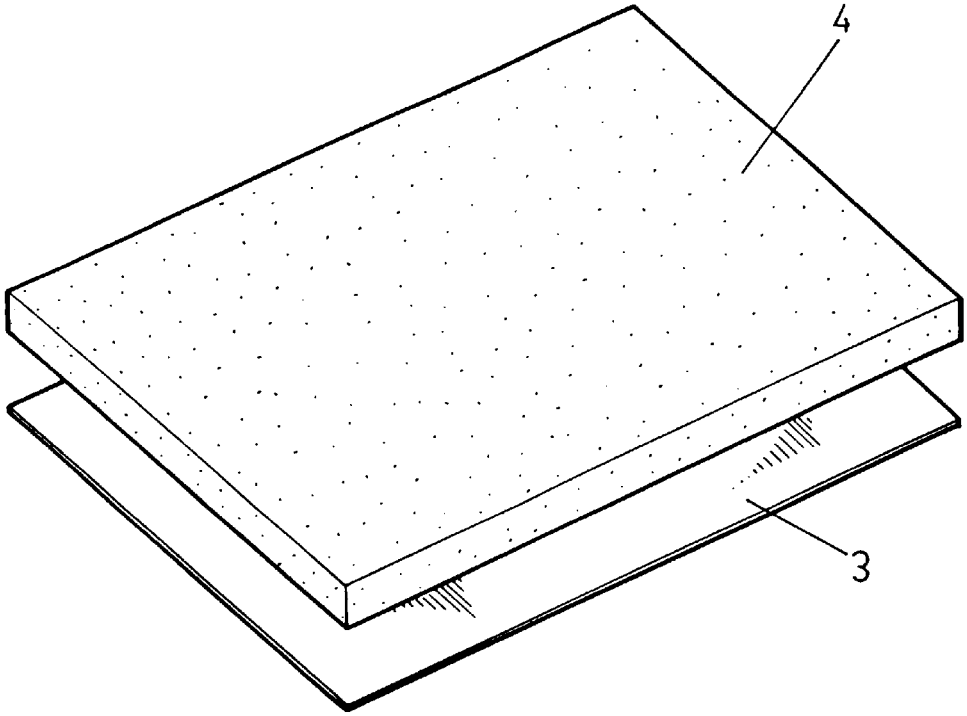
FIG. 2 is an exploded drawing of a piece of patch fabric adhered to a piece of foam of the present invention.
Figure 3:
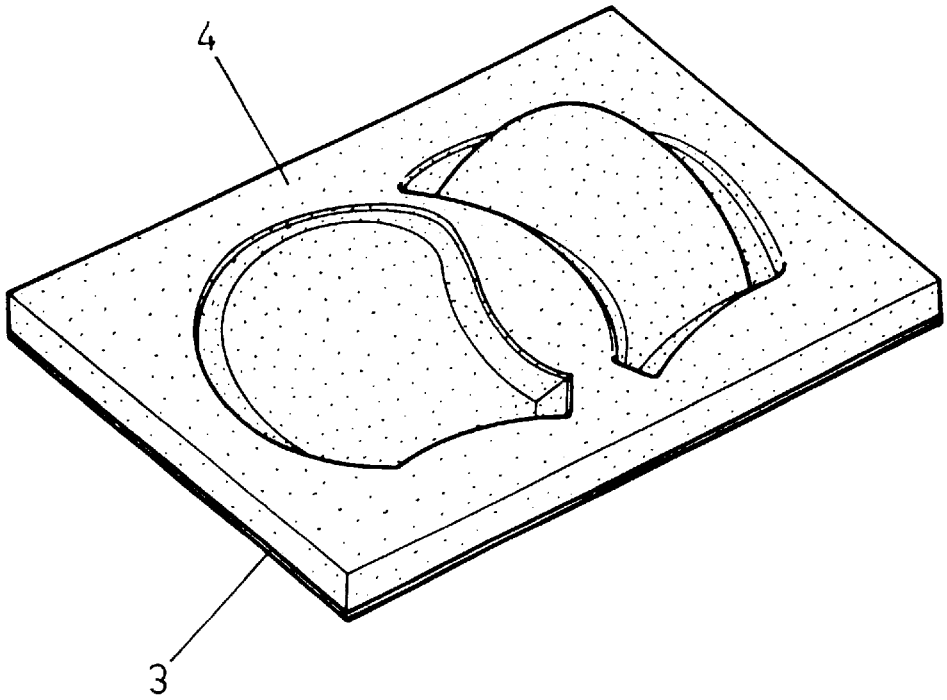
FIG. 3 is a structural drawing of using a die casting machine to mold for the first time.
Figure 4:
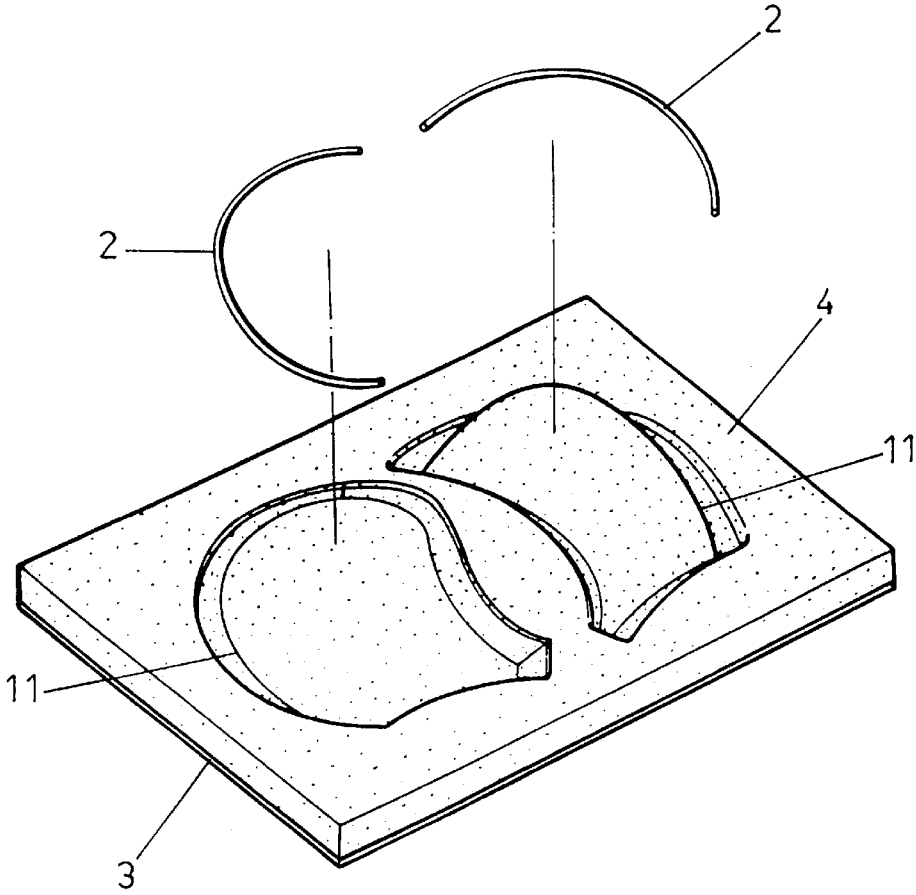
FIG. 4 is an exploded drawing of placing a steel wire on the first molded foam.
Figure 5:
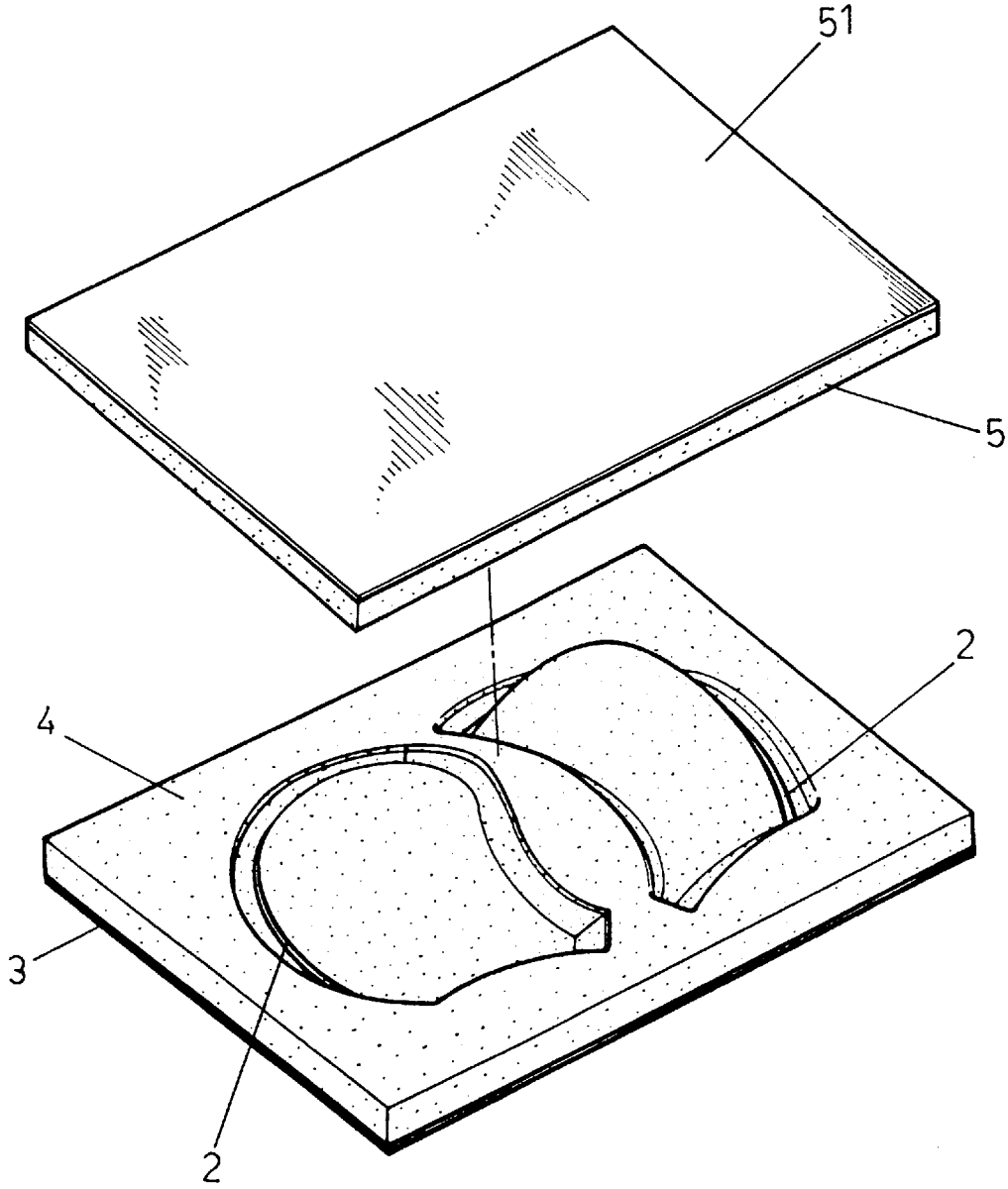
FIG. 5 is an exploded drawing of placing another piece of foam after placing the steel wire and before molding by die casting for the second time.
Figure 6:
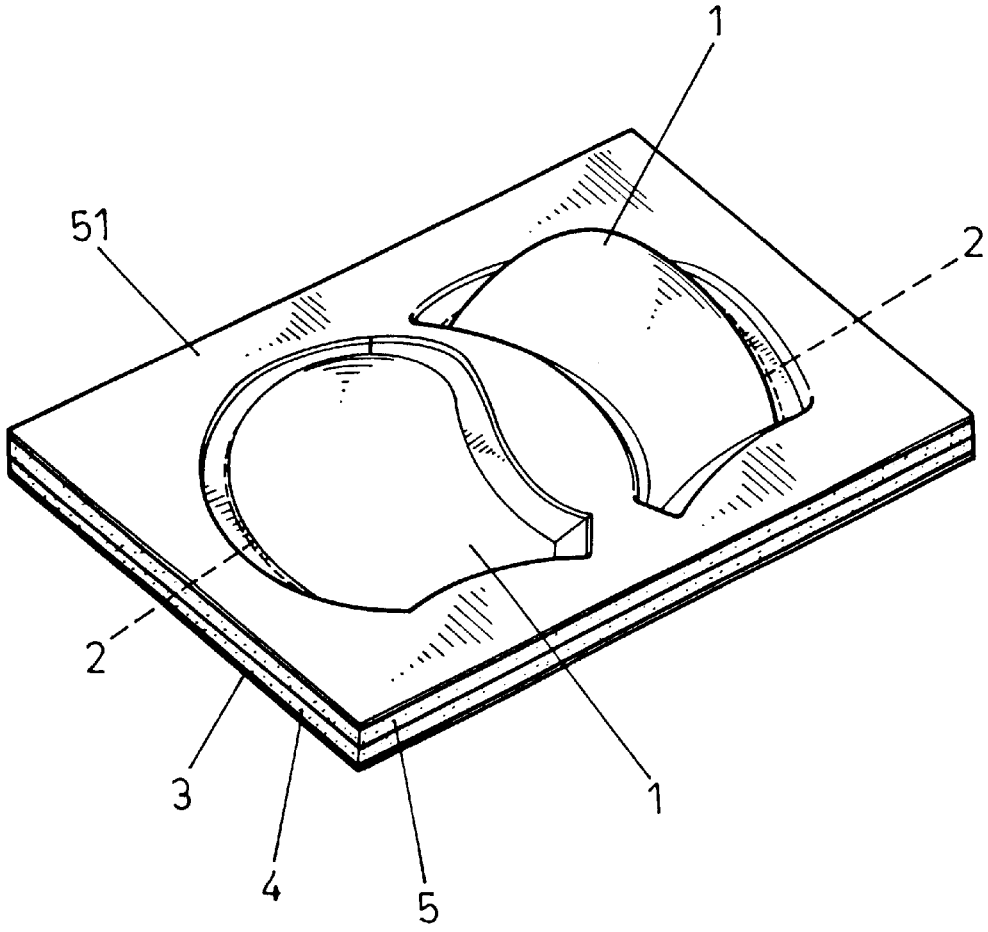
FIG. 6 is a structural drawing of using the die casting machine to mold for the second time.
Figure 7:
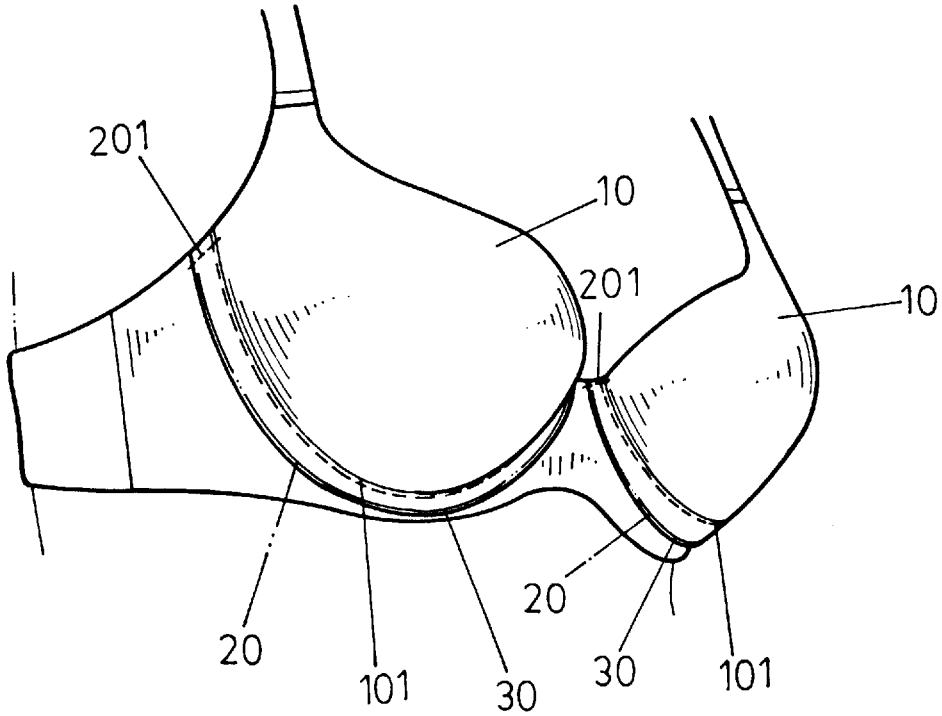
FIG.7 (PRIOR ART)
FIG. 7 is a drawing of an external view of a prior art product.

As indicated in FIG. 1, the present invention of a bra has arcuate steel wires (2) placed and positioned inside groove channels (11) at lower rims of two breast cups (1) thereof by using a die casting machine to mold at a high temperature twice. The steel wires (2) completely fill in the groove channels (11) thereby more completely supporting the breast shapes of the breast cups (1) without requiring a seaming method so as to save the labor time and cost of seaming and processing manufacture. The procedure of manufacturing the breast cups (1) is as follows:

1. Referring to FIG. 2, first a piece of patch fabric (3) of 100% polyester is adhered to one side of a piece of foam (4) by glue; then the foam (4) with one side adhered is cut into a small rectangular block.
2. Face the side of the patch fabric (3) of the rectangular block downwardly and use the die casting machine to mold for the first time at a high temperature, as shown in FIG. 3. Place the steel wires (2) onto the groove channels (11) of the foam (4) breast cups (1), as shown in FIG. 4.
3. Place another piece of not molded foam (5) with one side thereof adhered and the side of the patch fabric (51) facing upwardly on the foam (4) and the steel wires (2), as shown in FIG. 5. Die cast the foam (5) for the second time at a high temperature to finish molding the breast cups (1).
4. Cut the molded foam (4) breast cups (1) along the side lines to finish the manufacture.

Then conventional members, such as an upper side piece (6) and a shoulder strap (7) are seamed respectively onto the left and right breast cups (1) manufactured through the abovementioned steps and methods thereby forming the bra as shown in FIG. 1. The steel wire (2) on the bottom rim of the breast cup (1) of the bra is not seamed and inserted for fixing, it is completely placed inside the groove channel (11) of the breast cup (1). That does not destroy the entire external view of the bra; furthermore, the steel wire (2) affixed closely to the breast cup (1) is able to support the breast shape of the bra completely.

In summation of the abovementioned, the present invention utilizes the method of using a die casting machine to mold twice at a high temperature thereby directly placing the arcuate steel wires (2) into the groove channels (11) on the bottom rims of the breast cups (1). It is very simple and fast to dispose the steel wires (2) into the bra for positioning entirely in the groove channels (11) of the breast cups (1) so as to support the breast shapes of the bra more completely.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A method of manufacturing breast cups of a bra comprising the following steps:

a) adhering a piece of patch fabric to a first side of a piece of foam;

b) cutting said piece of foam with the adhered patch fabric into at least a first block and a second block;

c) positioning said first block so that the side of said first block with the adhered patch fabric is facing downward;

d) using a die casting machine to mold said first block at a high temperature so that a pair of breast cups are formed, each said breast cup having a receiving groove formed at a periphery thereof;

e) placing steel wires into said receiving grooves of said breast cups;

f) positioning said second block so that the side of said second block with the adhered patch fabric is facing upward, with said second block covering said steel wires;

g) placing said first block and said second block into said die casting machine at a high temperature to complete the molding of said breast cups; and h) cutting the molded foam breast cups along side lines to remove them from said blocks.

* * * * *